US005986616A

United States Patent [19]

Edvardsson

[11] Patent Number: 5,986,616

[45] Date of Patent: Nov. 16, 1999

[54] ANTENNA SYSTEM FOR CIRCULARLY POLARIZED RADIO WAVES INCLUDING ANTENNA MEANS AND INTERFACE NETWORK

[75] Inventor: Olov Edvardsson, Täby, Sweden

[73] Assignee: Allgon AB, Akersberga, Sweden

[21] Appl. No.: 09/223,380

[22] Filed: Dec. 30, 1998

[30] Foreign Application Priority Data

Dec. 30, 1997 [SE] Sweden ..... 9704938

[51] Int. Cl.[6] ..... H01Q 21/00; H01Q 1/36; H01P 5/12

[52] U.S. Cl. ..... 343/853; 343/895; 343/850; 343/858; 333/116; 333/117; 333/219; 333/128

[58] Field of Search ..... 343/895, 702, 343/850, 853, 857, 858; 333/116, 117, 219, 21 A, 128, 136, 161

[56] References Cited

U.S. PATENT DOCUMENTS

| | | | |
|---|---|---|---|
| 5,191,352 | 3/1993 | Branson | 343/895 |
| 5,255,005 | 10/1993 | Terret et al. | 343/895 |
| 5,349,384 | 9/1994 | Bryanos et al. | 343/853 |
| 5,541,617 | 7/1996 | Connolly et al. | 343/895 |
| 5,705,962 | 1/1998 | Fleeger et al. | 338/136 |
| 5,793,338 | 8/1998 | Standke et al. | 343/895 |
| 5,828,348 | 10/1998 | Tassoudji et al. | 343/895 |

FOREIGN PATENT DOCUMENTS

| | | |
|---|---|---|
| 0520564 | 12/1992 | European Pat. Off. . |
| 2246910 | 2/1992 | United Kingdom . |
| WO97/06579 | 2/1997 | WIPO . |
| WO97/11507 | 3/1997 | WIPO . |

*Primary Examiner*—Don Wong
*Assistant Examiner*—Jennifer H. Malos
*Attorney, Agent, or Firm*—Jacobson, Price, Holman & Stern, PLLC

[57] ABSTRACT

An antenna system for a radio communication device, in particular a hand-portable telephone, having communication circuits and to be operating by circularly-polarized radio waves. In the system (1) there is provided a radiation means, preferably helical elements (2, 3, 4), a feeding network (8) having first coupling means (9) adapted for coupling to said communication circuits and second coupling means coupled to said helical elements (2, 3, 4). The interface means includes a closed resonator means (14), which has at least a first portion associated with said first coupling means (9), and having separated at least second (11), third (12) and fourth (13) portions forming said second coupling means (11, 12, 13).

28 Claims, 8 Drawing Sheets

ANTENNA SYSTEM FOR CIRCULARLY POLARIZED RADIO WAVES INCLUDING ANTENNA MEANS AND INTERFACE NETWORK

FIELD OF THE INVENTION

The invention relates to an antenna system to be operating by circularly polarized radio waves and including radiation means and a radiator interface circuit means. The antenna system of the invention is particularly suited for use in preferably terrestrial terminals of satellite based telecommunication systems.

In such systems it is customary for technical reasons to use circularly polarized radio waves in the communication between a satellite and a mobile terminal, preferably, but not limited to, a hand held terminal in the present context. One important technical reason is that circularly polarized radio waves allow for more freedom in the spatial orientation of El transmitting antenna and a receiving antenna compared to, for example, linearly polarized antennas.

In this disclosure, circular and elliptical polarizations and similar are collectively referred to as circular polarization.

RELATED PRIOR ART

Several antenna systems intended for use in satellite communication are known from patents and published patent applications. A large number of these disclose quadrifilar antenna structures for circularly polarized radio signals. See, for example, WO 97/06579, WO 97/11507, U.S. Pat. Nos. 5,191,352, 5,255,005, and 5,541,617. Although published application GB 2 246 910 A, which forms one basis of priority of above mentioned U.S. Pat. No. 5,191,352, claims an antenna comprising a plurality of helical elements and EP 520 564 A2 mentions a structure of two or more antenna elements (naming only 2, 4, 8, and 16 explicitly), there is no prior art teaching of how to actually realize a multifilar helical antenna having three helical elements. Three helical elements is however the least number of with which it is possible to resolve the rotational direction of the associated circularly polarized radiation field.

Several of the above mentioned documents suggest quadrifilar antennas for hand portable telephones for use in systems like Iridium, Globalstar etc. Global Positioning System (GPS) is another typical application. The quadrifilar structure is one standard solution for antennas in these systems using circularly polarized signals. In order to attain a certain radiation pattern, the diameter and pitch of the helical elements should be selected accordingly, but the number of helical elements may be, in principle, freely selected equal to or greater than three (to define direction of rotation) as long as they are fed in progressive phase. The helical elements may be realized in various ways. One possible solution is to print or etch, together with a feeding network, a conductor pattern on a thin flexible dielectric substrate which is then rolled into a cylinder.

Four helical elements per antenna are commonly used since it is easy to design feeding networks (see for example WO 97/06579) that provide 0, 90, 180, and 270 degrees of phase progression. However, a smaller number of helical elements is desirable when designing for compactness of the antenna. If the antenna has a circular cylinder shape, both its diameter and length are typically desirable to keep small for use on a hand-portable telephone. For example, in multiband antennas there is a particular demand for housing several radiators in a small volume.

Thus, in spite of several useful teachings in the prior art, related to quadrifilar antennas and modifications thereof, for achieving compact structures, it is a remaining problem therein to reduce the number of antenna elements of an antenna system for radio waves having circular polarization. As will be appreciated, the invention will also allow free selection of the number of helical elements in a multifilar antenna for circular polarization.

SUMMARY OF THE INVENTION

In this disclosure it is to be understood that the antenna system of the invention is operable to transmit and/or receive radio signals. Even if a term is used herein that suggests one specific signal direction it is to be appreciated that such the situation covers that signal direction and/or its reverse.

It is a main object of the invention to provide an antenna system for circularly polarized signaling which is compact and allows for further miniaturization of an antenna for a terminal, in particular a hand-held terminal. Another object is to provide operability at multiple frequency bands. Yet further object are to provide an antenna system which is suited for large quantity production, high performing, and cost efficient.

These and further objects are attained by an antenna system according to the invention.

The invention uses a ring or closed loop resonator having a (circumferential) effective length of one wavelength having preferably three equally spaced feeding portions each feeding one of three equal helical radiation elements.

Further, the ring resonator itself is fed by means that causes the signal to propagate in the ring resonator in only one selected direction. The ring resonator may have the length of N times the wavelength, where N is an integer. The same feeding principle may also be used for a greater number of wires than three. It may also be applied to other radiating structures having a 3-symmetry such as patch antennas which have also found an extensive use as antennas for circular polarization. The patches can be located on a flat surface as well as on a cylinder.

The dependent claims recite various enhancements of the invention in attaining above mentioned objects. Several different types of resonant structures may be employed alternatively in the invention, as will be evident from the detailed description below.

BRIEF DESCRIPTION OF THE DRAWINGS

It should be noted that the drawings are not necessarily drawn to scale and proportions, but are intended to provide and facilitate understanding of the invention in order for a skilled person to apply the invention.

DESCRIPTION OF PREFERRED EMBODIMENTS

Figure 1:
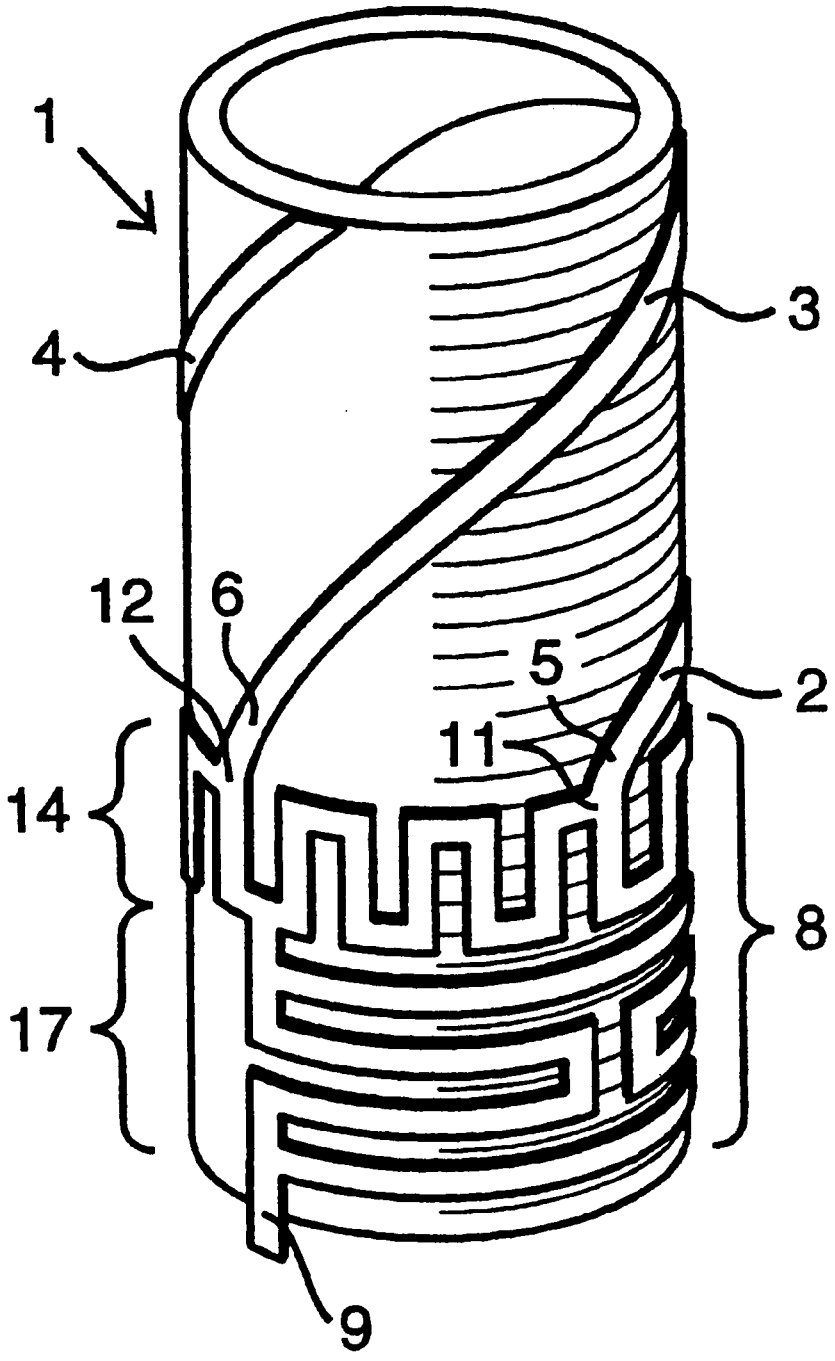
FIG. 1 shows in a perspective view an antenna system according to one embodiment of the invention including three helical radiation elements, an interface network and carrier means together forming an elongated cylindrical antenna unit.

In the appended drawings, corresponding parts in different figures may have the same reference numerals when they have the same or a similar function.

With reference to FIG. 1 and other figures where applicable, an embodiment of the invention is an antenna system 1 arranged in cylindrical form, for example as a flexible printed circuit board applied on a cylindrical carrier. The system includes in an upper portion first 2, second 3 and third 4 helical antenna elements with free upper ends and lower ends 5, 6, 7, respectively. In a lower portion there is provided a feeding network or interface means 8 for connecting via a connection point 9 the antenna elements to circuits of a preferably hand portable telephone (not shown). It is possible to include further components, for example a low noise amplifier for incoming signals, in the same structure as the antenna system. The feeding network has three connection points 11, 12, 13 for the helical elements 2, 3, 4, respectively, along a closed loop resonant structure 14 having, in this embodiment, a meander form and an electrical length of one wavelength. The connection points are equally spaced around the resonant structure 14, i.e., geometrically around the cylinder and electrically regarding the phase of the resonating signal. A 90 degree hybrid circuit 17 connects the resonant structure 14 and the connection point 9. In the feeding network, there is included a ground plane means (not shown in FIG. 1) interacting with the resonant structure 14 and the 90 degree hybrid.

Figure 2:
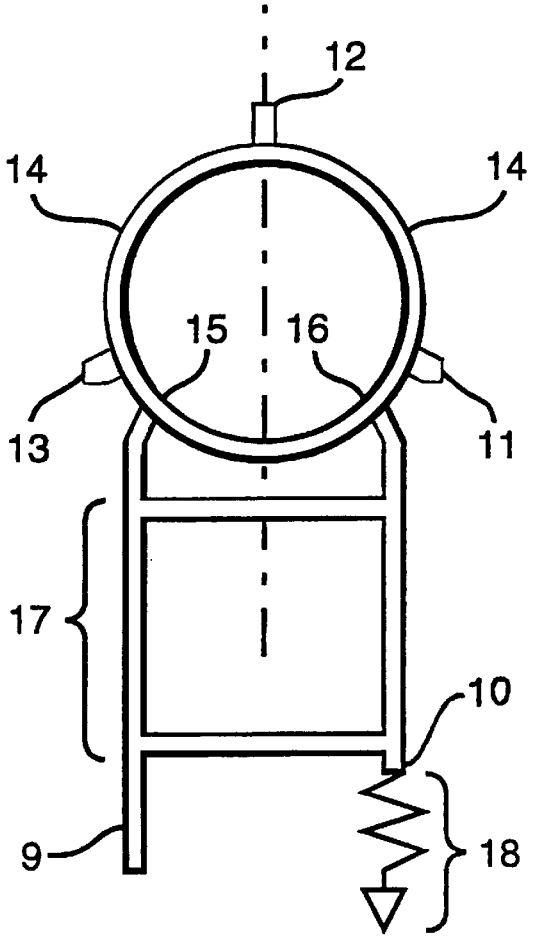
FIG. 2 illustrates the operation principle of the interface network in FIG. 1 including a first alternative feed means.

FIG. 2 illustrates the working principle of the invention wherein the antenna system is fed at the connection point 9 to a 90 degree hybrid circuit 17, which is well known in the art and has two outputs and one termination point 18 exhibiting typically 50 ohms to ground. A closed loop resonant structure 14 is fed by the hybrid circuit 17 at connection points 15, 16. Outputs 11, 12, 13 of the resonant structure are indicated by tabs where helical elements are connected in operation. A symmetry axis is indicated and the connection points 15, 16 are located with reference thereto at −45 and +45 degrees, respectively. Since these connection points 15, 16 are fed by a 90 degree phase difference the result is that a signal entering the resonant structure 14 will propagate in only one rotational direction. The outputs 11, 12, 13 are located at +60, 180, −60 degrees, respectively, relating to the symmetry axis. Thus, the resonant means 14 provide a signal at its outputs 11, 12, 13 all having 120 degrees of mutual phase difference. This enables the operation with circularly polarized radio waves. It is possible to alternatively locate the connection points 15, 16 at −135 and +135 degrees with the same reference as above, with care taken to achieve a desired rotational direction.

Figure 3:
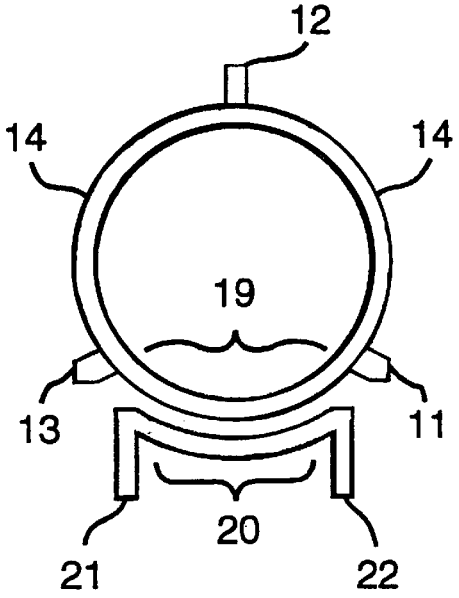
FIG. 3 illustrates the principle of FIG. 2 but the network here includes a second alternative feed means.

FIG. 3 illustrates an alternative to the 90 degree hybrid circuit in FIG. 2 for feeding the resonant structure 14. A portion 19 of the resonant structure 14 interacts with a corresponding portion 20 of a conductor arranged substantially in parallel to the portion 19. The two portions together form a directional coupler well known in the art enabling a signal at its inputs 21, 22 to be fed in one direction only in the resonant structure 14.

Other structures than those of FIGS. 2 and 3 feeding the resonant structure are possible. Also, there could be provided means for feeding in a controllable way signals in both rotational directions in the resonant means in case radio waves of opposite circular polarization are employed. Other possible structures for the resonant structure is a plastic or ceramic resonator body with input and output coupling means instead of a microstrip structure as in the examples herein. It is also possible to use a separate metal ring (possibly cut for meander shape and flexibility) as the resonant structure in embodiments similar to the ones described herein.

Figure 4:
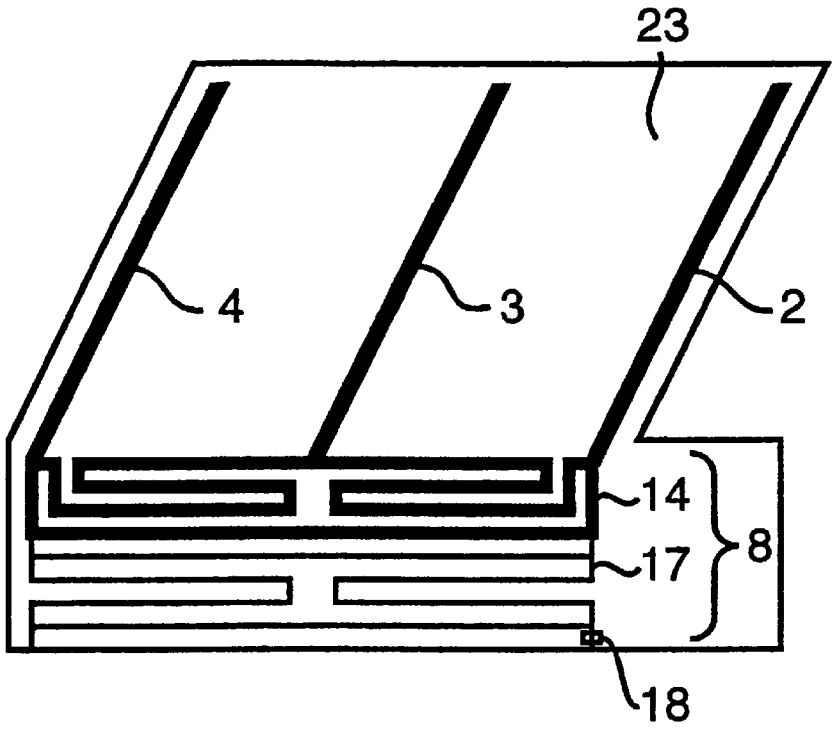
FIG. 4 shows a first face of an antenna system similar to that of FIG. 1 formed by printed circuits on a thin flexible substrate to be rolled into cylindrical shape, wherein the interface network includes a meander shaped ring resonator and a 90 degree hybrid.
Figure 5:
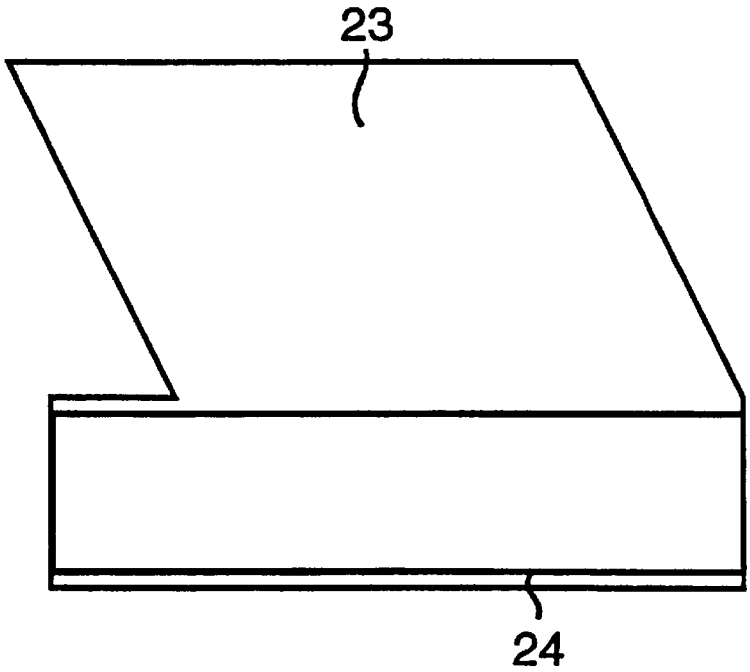
FIG. 5 shows a second face of the antenna system of FIG. 4 including a ground means opposite the interface network thereof.
Figure 6:
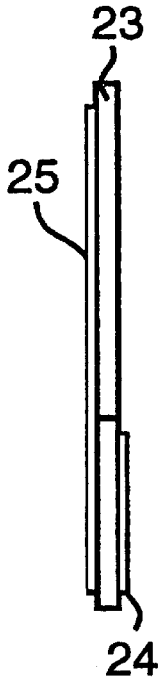
FIG. 6 shows a side view of the antenna system of FIGS. 4 and 5.

FIGS. 4, 5 and 6 show front, rear and side views, respectively, of a flexible printed circuit board to form a second embodiment the antenna system when cylindrically configured. The basic mechanical structure of this antenna system is similar to that of the antennas disclosed in WO 97/11507. This embodiment includes parts corresponding to those of FIG. 1. However, the resonant structure 14 is different in that it is a closed loop which does not require a connection between its opposing ends (left and right in FIG. 4). FIG. 5 shows specifically a ground means 24 forming part of the feeding network 8 and to be coupled to signal ground of the telephone (not shown). FIG. 6 shows a side view including the conductive patterns 24, 25 on the rear and front side, respectively, of a flexible substrate 23.

Figure 7:
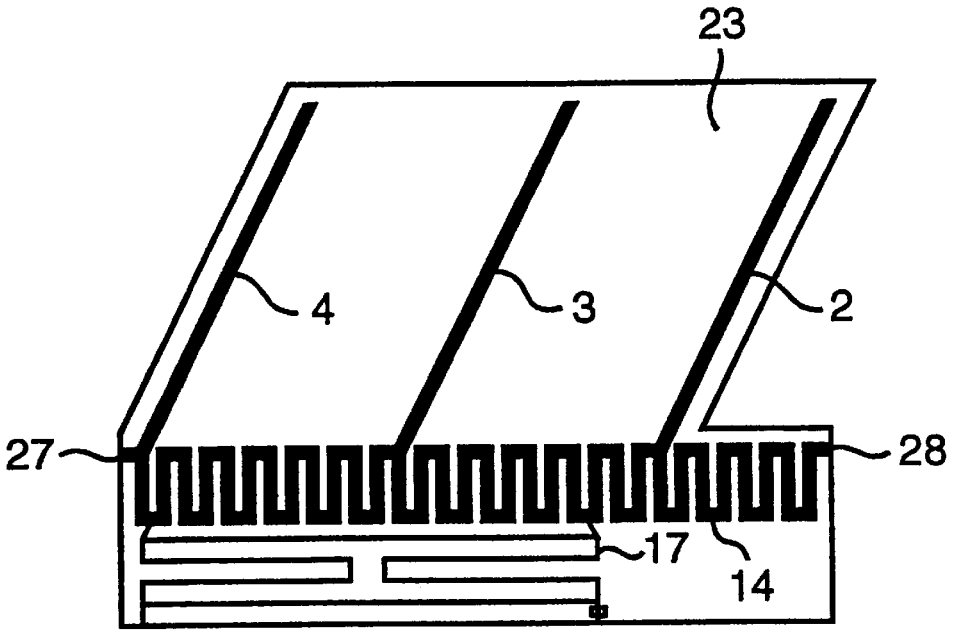
FIG. 7 shows a first face of an antenna system according to a second embodiment of the invention formed by printed circuits on a thin flexible substrate to be rolled into cylindrical shape, wherein the interface network includes a ring resonator shaped differently to that in FIG. 4 but fed by the same 90 degree hybrid.
Figure 8:
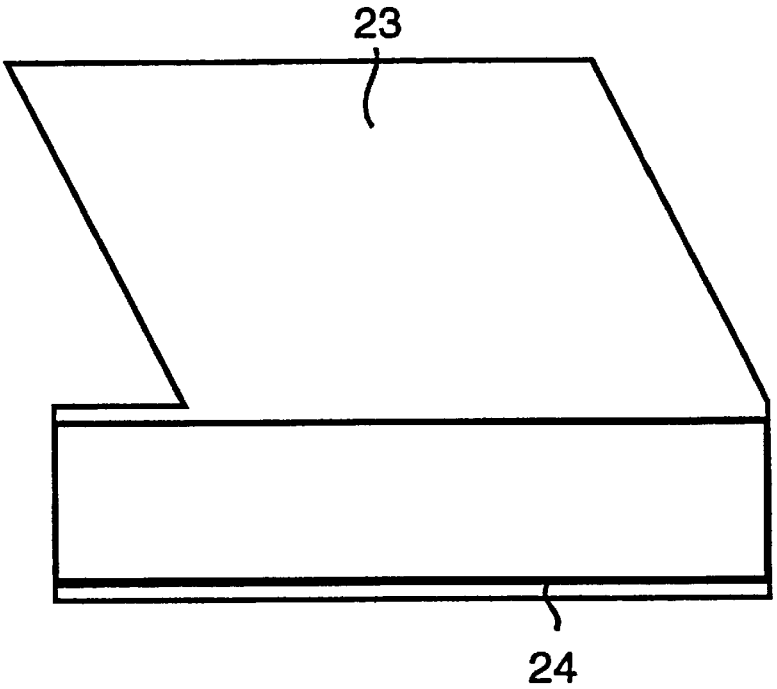
FIG. 8 shows a second face of the antenna system of FIG. 7 including a ground means opposite the interface network thereof.
Figure 9:
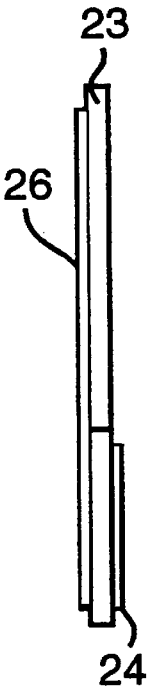
FIG. 9 shows a side view of the antenna system of FIGS. 7 and 8.

FIGS. 7, 8 and 9 show front, rear and side views, respectively, much similar to FIGS. 4, 5, 6, but including a variation of the resonant structure 14 (corresponding to that of embodiment in FIG. 1). Here, the resonant structure 14 requires a connection between its opposing ends 27, 28 in order to close its loop when the printed circuit board is rolled into a cylinder. FIG. 8 shows the ground means 24. FIG. 9 shows a side view including the conductive patterns 24, 26 on the rear and front side, respectively, of the flexible substrate 23.

Figure 10:
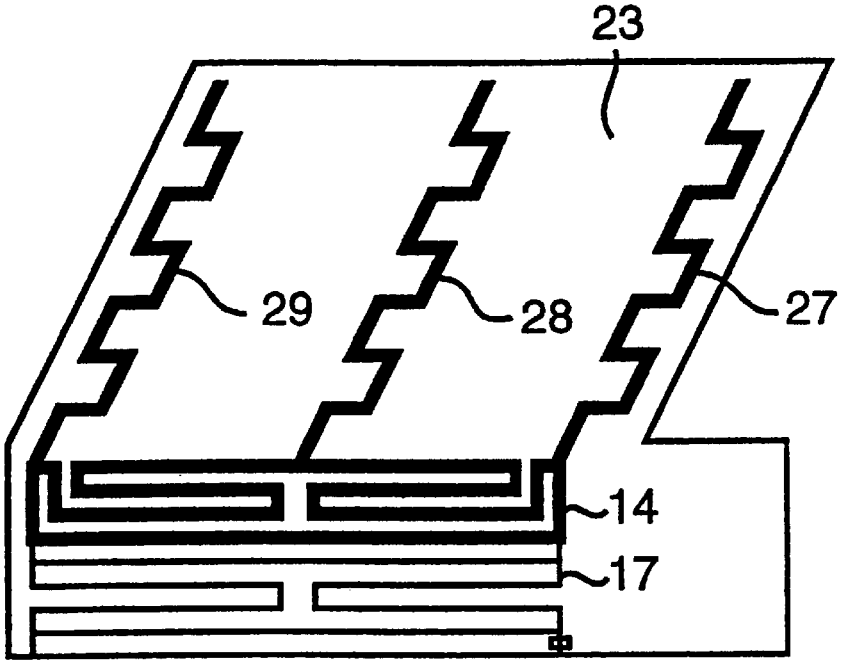
FIGS. 10, 11, 12 show first and second faces and a side view, respectively, of another embodiment of the invention similar to that of FIG. 4 wherein the radiation elements are also meander shaped to make them physically shorter.
Figure 11:
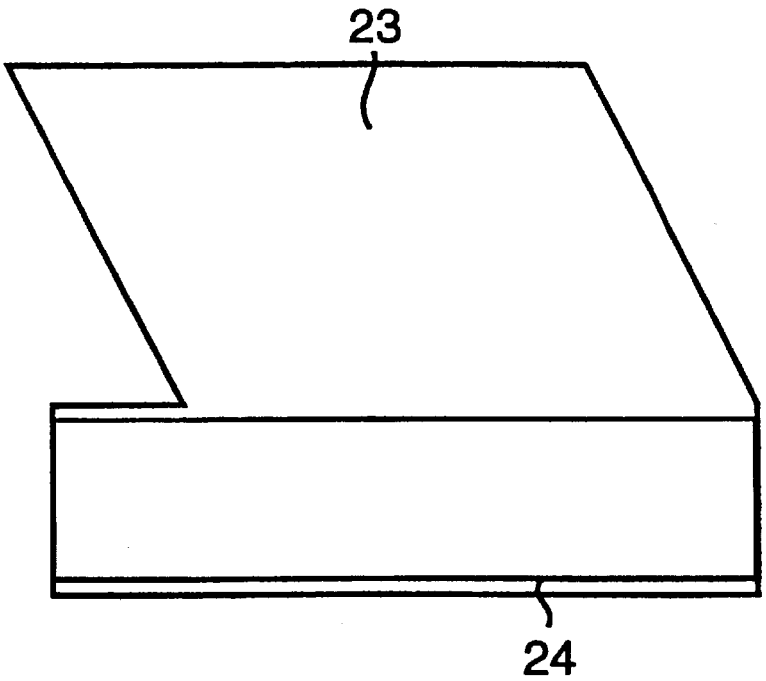
Figure 12:
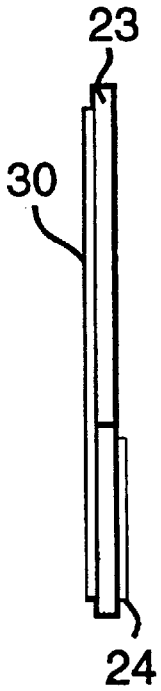

FIGS. 10, 11 and 12 show front, rear and side views, respectively, of a third embodiment much similar to FIGS.

4, 5, 6, but including a variation of the radiation elements. Here, radiation elements 27, 28, 29 each have a meander form which is to take also a generally helical form when the printed circuit board is rolled into a cylinder. This is a way to reduce the length of the inventive antenna system. However, it is generally applicable to a helical antenna to give it a meandering or wavy shape along its helical path to reduce length. FIG. 11 shows the ground means 24. FIG. 9 shows a side view including the conductive patterns 24, 30 on the rear and front side, respectively, of the flexible substrate 23.

Figure 13:
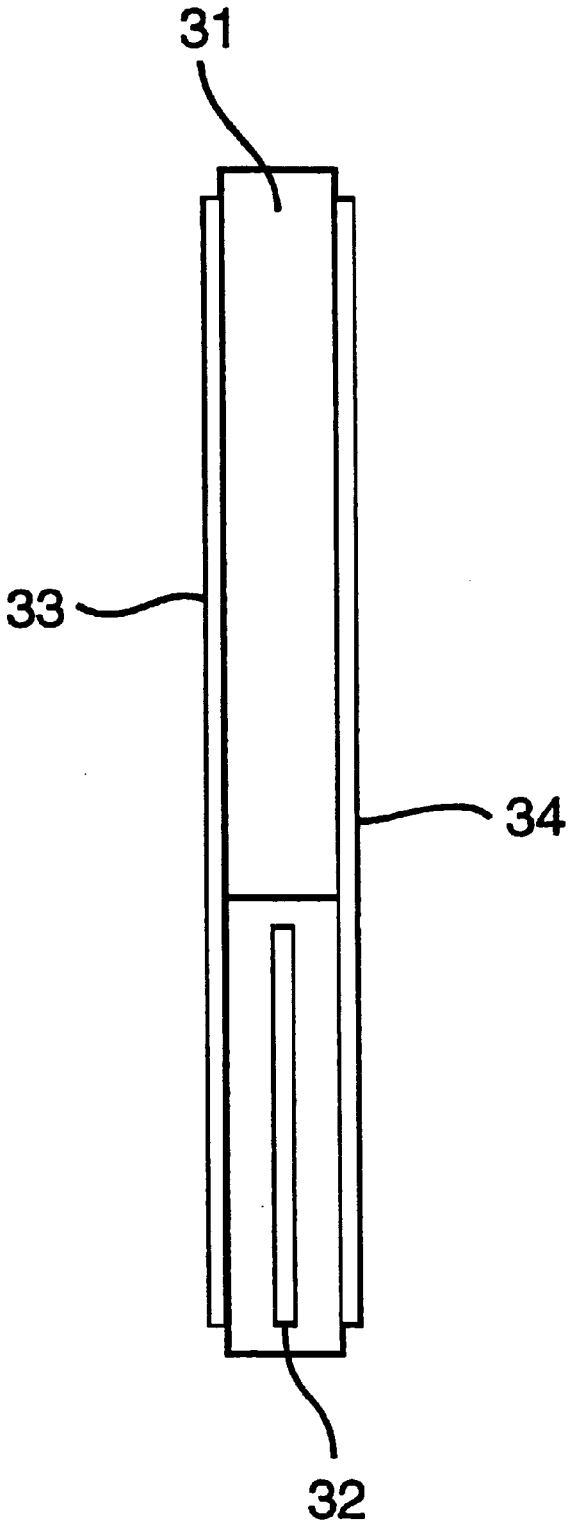
FIG. 13 shows a combined antenna system comprising essentially two antenna systems similar to that of FIG. 1 applied on opposing sides of a substrate that includes a ground means separating interface networks of the respective antenna systems.

FIG. 13 shows, in a manner corresponding to those of FIGS. 6, 9, 12, a fourth embodiment wherein a flexible substrate 31 is provided with a ground means 32 and conductor patterns 33 and 34 on both sides thereof. The conductive patterns 33, 34 can be independently any of those presented in the embodiments above.

Figure 14:
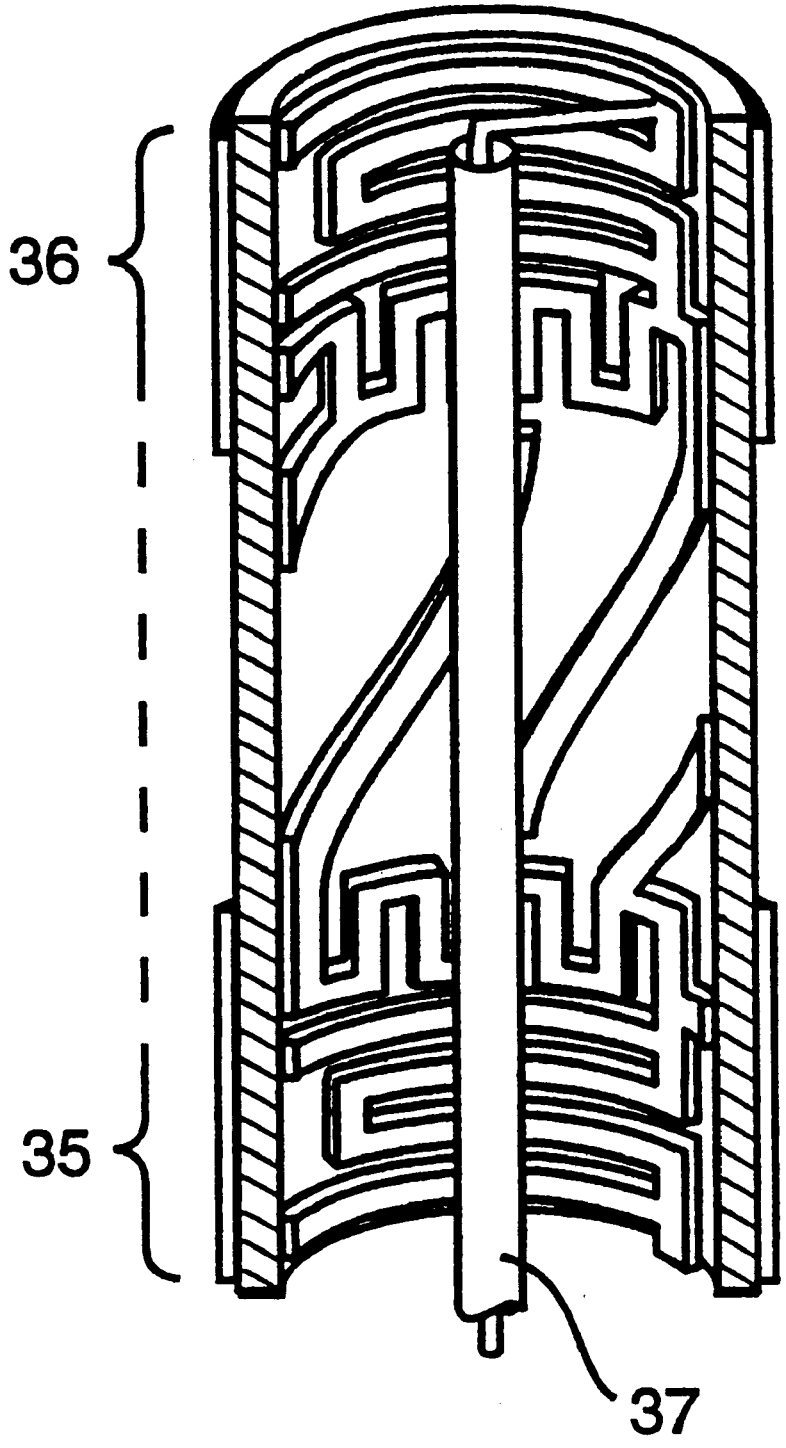
FIG. 14 shows a combined antenna system comprising essentially two antenna systems similar to that of FIG. 1 applied end to end on the same side of a substrate that includes a ground means opposite to each interface network.

FIG. 14 shows a sectional view of a fifth embodiment including the combination of two opposed antenna systems 35, 36 each similar to that of FIG. 1. One system 36 is fed by a coaxial cable through the interior of cylindrical configuration of this combined antenna system. It is generally regarded advantageous to arrange the ground means on the outside and the rest of the conductive pattern on the inside to provide less sensitivity to for example touch by a user's hand.

Figure 15:
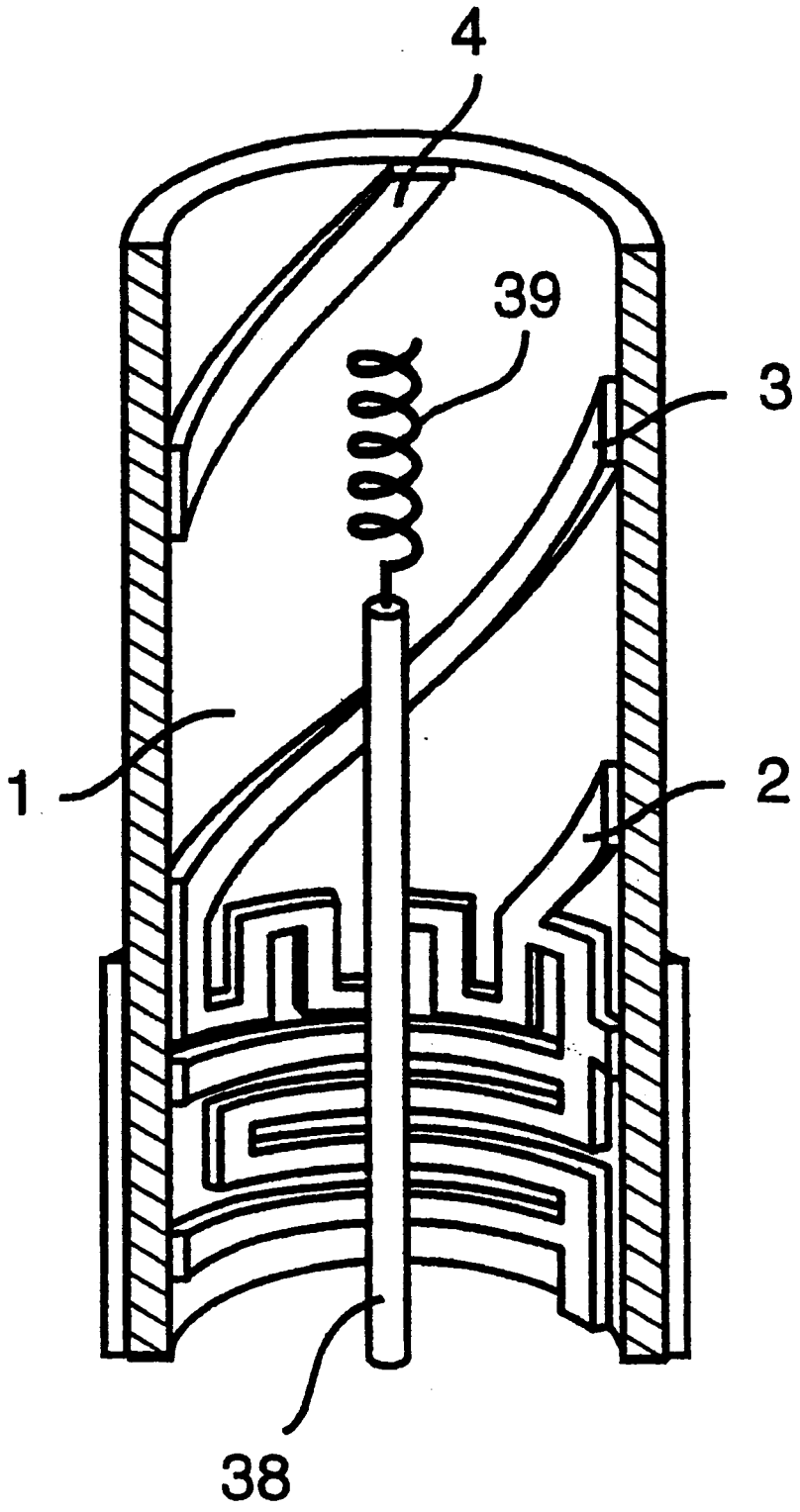
FIG. 15 shows a combined antenna system comprising essentially an antenna system intended for satellite based telecommunication and similar to that of FIG. 1 and an elongated antenna means intended for cellular ground based telecommunication, for example GSM, wherein this specific elongated antenna means includes an antenna rod carrying a coil at a first end and providing a feed point at a second end.

FIG. 15 shows a sectional view of a sixth embodiment including the combination of one antenna system 1 similar to that of FIG. 1 and a cellular telephone system antenna located centrally. In FIG. 15, the latter is indicated by an antenna rod 38 carrying at its top end a helical antenna 39. Of course, many other well known configurations of that antenna are possible. It is also possible to provide such a non-circularly polarized antenna function by an in phase feed of the helical elements 2, 3, 4.

It should be pointed out that the above described embodiments are examples only of how to apply the invention. Specifically, it is obvious to a skilled person to combine different features of the different embodiments to form further variations within the scope of this invention. At present, however, the second embodiment is preferred because of the specific configuration of the resonant structure therein.

I claim:

1. Antenna system for a radio communication device having communication circuits and to be operating by circularly-polarized radio waves, said system comprising:

a radiation means for circularly-polarized radio waves having an interface coupling means, an interface circuit means having first and second coupling means, said first coupling means being adapted for coupling to said communication circuits, said second coupling means being coupled to said interface coupling means, said interface circuit means including a closed loop means, said closed loop means being a resonator means, said resonator means having at least a first portion associated with said first coupling means, said resonator means having separated at least second, third and fourth portions forming said second coupling means.

2. The system according to claim 1, further comprising first, second and third elongated radiating elements each having first and second ends, said first ends being coupled to said second, third and fourth portions, respectively.

3. The system according to claim 2, wherein each of said radiating element having substantially helical geometry.

4. The system according to claim 2 wherein the number of radiating elements is equal to a multiple of three.

5. The system according to claim 1, wherein the resonator means has an effective length equal to a multiple of a wavelength of signals associated with said radio waves.

6. The system according to claim 1, wherein said first coupling means effects signals propagating in one rotational direction only in said resonator means.

7. The system according to claim 1, wherein said resonator means further includes a fifth portion associated with said first coupling means, said first and fifth portions have a predetermined first distance of separation along the resonator means said first and fifth portions are arranged so as to effect signals having a predetermined first phase difference corresponding to said first distance.

8. The system according to claim 7, wherein said first distance is substantially equal to one quarter of a wavelength of signals associated with said radio waves, said first and fifth portions are coupled to said first coupling means via a 90 degree hybrid known per se.

9. The system according to claim 1, further comprising a first conductor having first and second ends and being substantially parallel to said first portion, said resonator means and said first conductor forming in combination a directional coupler means, said first and second ends providing essentially said first coupling means.

10. The system according to claim 1, wherein said resonator means includes et meander shape.

11. The system according to claim 1, wherein said radiation means includes a meander shape.

12. The system according to claim 1, wherein said system has an overall shape of a cylinder shell thereby defining a longitudinal axis.

13. The system according to claim 12, wherein said resonator means forms a closed loop penetrated by said longitudinal axis.

14. The system according to claim 12, wherein said resonator means forms a closed loop not penetrated by said longitudinal axis.

15. The system according to claim 12, wherein said at least second, third and fourth portions are geometrically equally spaced on said resonator means around said longitudinal axis.

16. The system according to claim 1, wherein said at least second, third and fourth portions are electrically equally spaced on said resonator means.

17. The system according to claim 1, wherein said radiation means includes at least one patch antenna element.

18. The system according to claim 1, further comprising a further antenna means for essentially non-circularly polarized radio waves.

19. The system according to claim 18, wherein said radiation means forms part of said further antenna means.

20. The system according to claim 1, comprising in combination a further antenna system similar thereto.

21. The system according to claim 1, further comprising:

a second radiation means for circularly-polarized radio waves having a second interface coupling means, a second interface circuit means having third and fourth coupling means, said third coupling means being adapted for coupling to said communication circuits, said fourth coupling means being coupled to said second interface coupling means, said second interface circuit means including a second closed loop means, wherein said second closed loop means being a second resonator means, said second resonator means having at least a first portion associated with said third coupling means, said second resonator means having separated at least second, third and fourth portions forming said fourth coupling means.

22. The system according to claim 21, further comprising fourth, fifth and sixth elongated radiating elements each having first and second ends, said first ends being coupled to said second, third and fourth portions, respectively.

23. The system according to claim 22, wherein each of said radiating elements having substantially helical geometry.

24. The system according to claim 22 wherein the number of radiating elements is equal to a multiple of three.

25. The system according to claim 22, wherein said system has an overall shape of a cylinder shell having a bottom and a top end, the first interface circuit means being arranged in the vicinity of said bottom end, the second interface circuit means being arranged in the vicinity of said top end, and the first, second and third elongated radiating elements are interleaved with the fourth, fifth and sixth elongated radiating elements.

26. The system according to claim 21, wherein a ground means is arranged between the first and the second interface circuit means.

27. The system according to claim 1, wherein said system has an overall shape of a cylinder shell, and each interface circuit means being essentially encompassed by a ground means.

28. The system according to claim 21, wherein said first coupling means effects signals propagating in one rotational direction only in said resonator means, and said third coupling means effects signals propagating in one rotational direction only in said second resonator means.

* * * * *